US005121885A

United States Patent [19]

Chipman

[11] Patent Number: 5,121,885

[45] Date of Patent: Jun. 16, 1992

[54] SHEET FABRIC SLITTER AND REROLLER

[76] Inventor: Donald I. Chipman, 3581 Fourth SW., Box 1103, Mason City, Iowa 50401

[21] Appl. No.: 636,701

[22] Filed: Jan. 2, 1991

[51] Int. Cl.[5] ..... B26D 1/03

[52] U.S. Cl. ..... 242/56.4; 83/107; 83/425.4; 83/649; 83/949; 242/58.6; 242/68.4; 242/75.41; 242/79

[58] Field of Search ..... 83/425.4, 425.3, 436, 83/649, 102, 107, 733, 937, 938, 345, 949; 242/75.41, 58.6, 79, 684

[56] References Cited

U.S. PATENT DOCUMENTS

| | | | |
|---|---|---|---|
| 527,879 | 10/1894 | Potter | 242/58.6 |
| 1,357,352 | 11/1920 | Scott | 242/68.4 |
| 3,348,785 | 10/1967 | Cocker, III | 242/58.6 |
| 3,628,710 | 12/1971 | Stehle et al. | 83/107 X |
| 3,762,250 | 10/1973 | Huskey | 83/107 X |
| 3,971,279 | 7/1976 | Wright | 83/425.4 |
| 4,649,782 | 3/1987 | Caragna | 83/425.4 |
| 4,674,380 | 6/1987 | Hecht et al. | 83/425.4 X |
| 4,781,336 | 11/1988 | Rosenthal et al. | 242/75.41 X |
| 4,819,528 | 4/1989 | Chadwick | 83/425.4 X |
| 4,899,630 | 2/1990 | Shioya et al. | 83/425.4 |

*Primary Examiner*—Frank T. Yost
*Assistant Examiner*—Kenneth E. Peterson

[57] ABSTRACT

A machine for slitting roller material such as plastic sheet into strips or ribbons including a device for loading the roll of material onto the machine, simplified tension controls, so that materials can be rolled onto different diameter rolls and adjustable slitting knives so that strips of various width can be cut either simultaneously or in serial fashion requiring a minimum of set up time.

2 Claims, 5 Drawing Sheets

SHEET FABRIC SLITTER AND REROLLER

BACKGROUND AND SUMMARY OF THE INVENTION

This invention pertains to devices for slitting rolled material and rerolling the strips after slitting has been accomplished. The device is easily used because of simplified tension controls on the rolls, easy adjustment of slitting knives and easy loading and unloading.

In any industry where the use of ribbons or strips of material of a width narrower than the standard manufactured roll is indicated, the use of a machine to slit the standard width material may be desirable. Frequently, such narrower strips are more conveniently stored on rolls than folded or flat. Therefore an economical machine to slit a sheet of rolled material and then to reroll the cut material is needed.

The machine of the present invention accomplishes the desired result. A sheet of material is easily loaded, slit into strips of any chosen width or widths and then is rerolled on either of two or more spindles. A tension brake is used to provide proper tension in the material as it goes through machine, and to control the spinning of the original roll so that inertia doesn't cause excessive unrolling of the material. Adjustable slitting knives make it possible to adjust the width of the cut material between each run.

A more complete understanding of the invention in its embodiment may be had from the following specification and the figures.

DESCRIPTION

Figure 1:
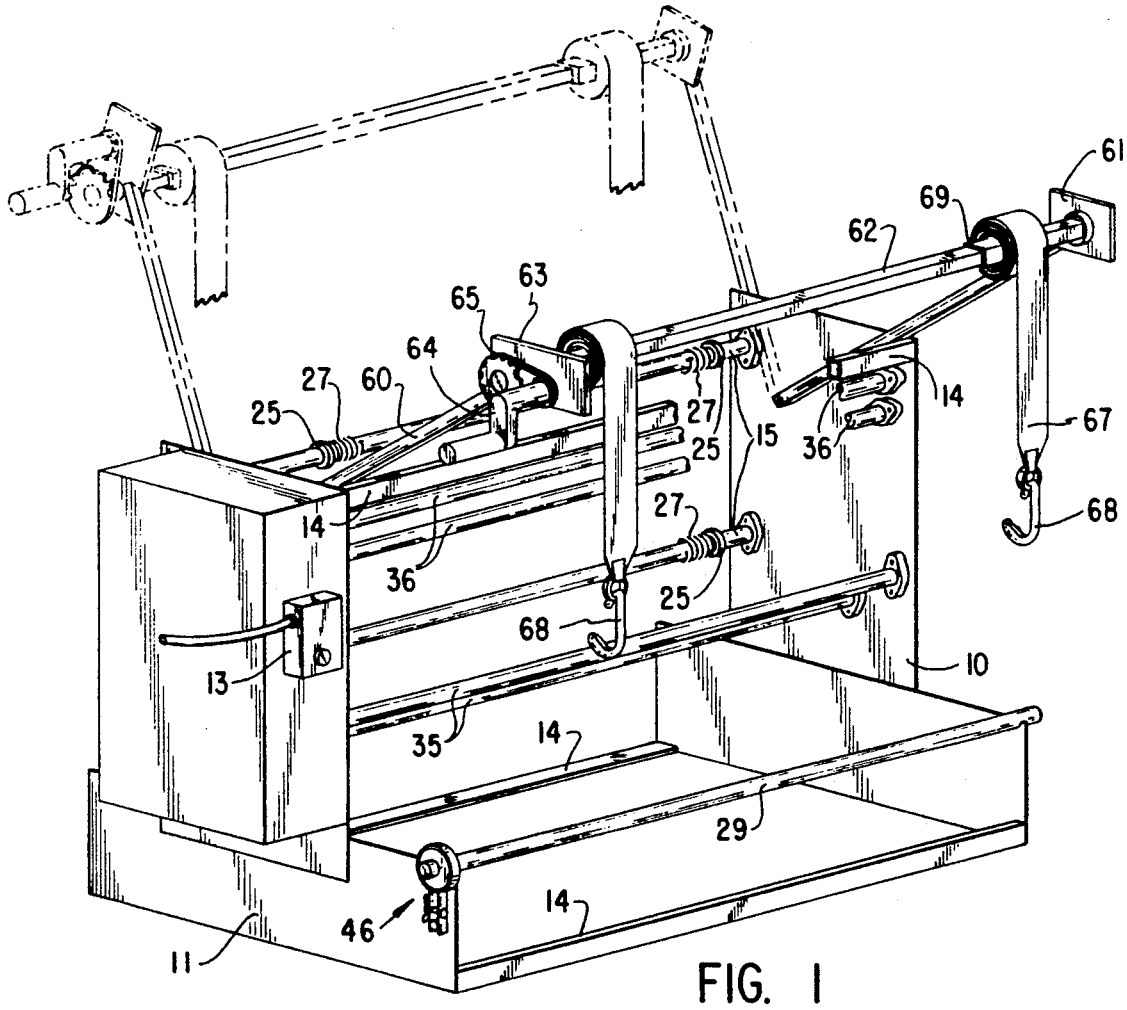
FIG. 1 is a perspective view of the machine showing the loading and unloading mechanism.

Briefly my invention comprises a relatively simple machine for slitting rolled material having great flexibility and ease of operation.

The machine consists principally of two end plates, the first plate 10 being simply a bearing holder, and a second plate 11 adapted to carry a drive motor in a housing 12. The motor is driven from an ordinary electrical power source and is controlled by a switch 13.

The plates 10 and 11 are held in spaced parallel relation by a series of bars 14, thus forming a framework for the support of the various shafts required for the device.

Figure 8:
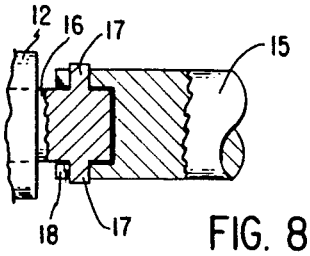
FIG. 8 is a view similar to FIG. 7 of the driven end of a take-up shaft showing the drive connection.
Figure 7:
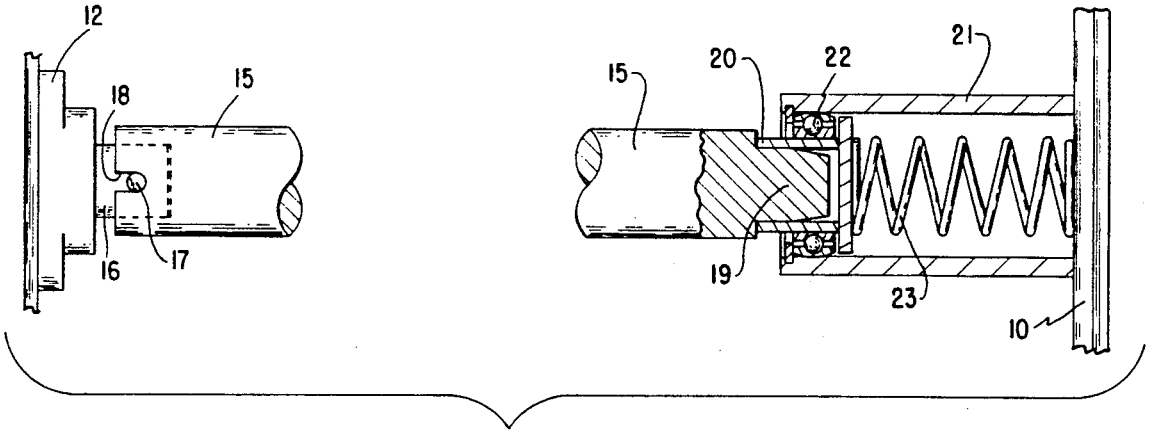
FIG. 7 is a view to an enlarged scale, and partly in section showing a shaft—and particularly a take-up shaft with arrangements for quick assembly.

There are two identical driven shafts 15 driven by a motor 12 and used to drive the rewinding spools. It will be obvious that more than two could be used. As best shown in FIGS. 7 and 8, the shafts 15 are driven through stub shafts 16. The stub shafts are provided with radial extensions or pins 17 either formed on the shaft or using a pin extending through the shaft. The drive shaft 15 is formed with a notch 18 adapted to embrace the pins 17 so that power can be transmitted to the drive shaft 15.

At the end opposite the drive, the shaft has a tapered end 19 slidably fitted into a cup 20 which, in turn, is journalled in a housing 21 using a ball bearing 22. The housing 21 encloses a compression spring 23 adapted to press on the cup 20. The bearing 22 is slidable within the housing 21 so that the shaft 15 can be moved axially into the housing 21 far enough to disengage the notches 18 from the pins 17 and the shaft 15 from the stub shaft 16 for easy removal. Thus, the shafts can easily be taken off the machine to remove full spools of ribbon or to replace the spools. A ring 24 may be used to hold the bearing 22 within the housing 21.

Figure 2:
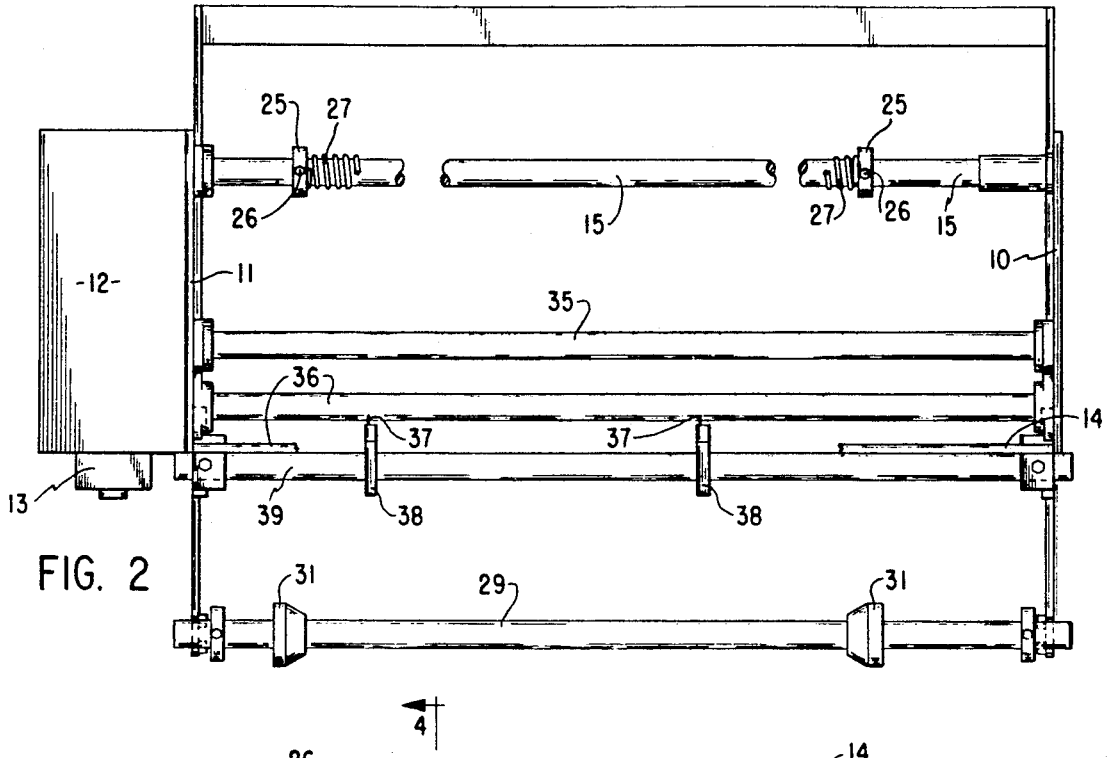
FIG. 2 is a top of the machine with the loading device removed.
Figure 3:
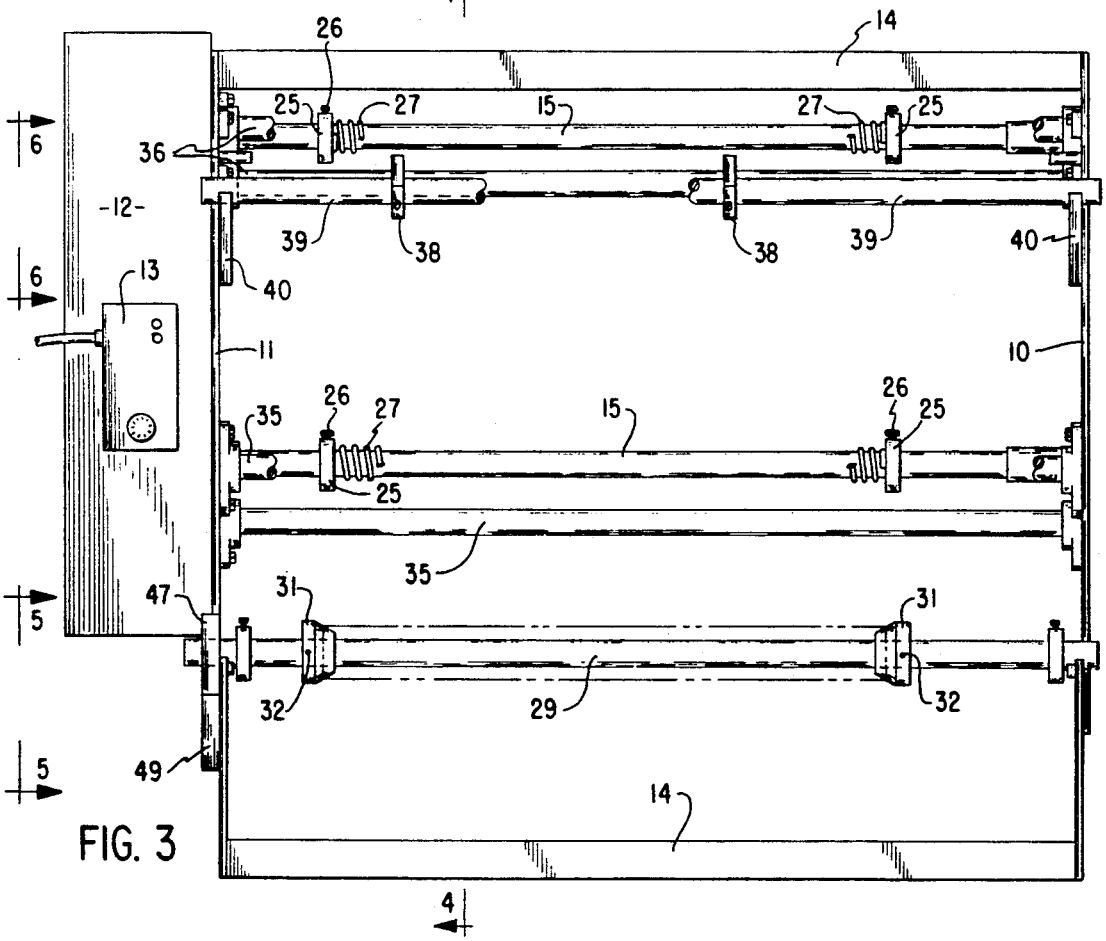
FIG. 3 is a front elevational view of the machine as in FIG. 2.

In order to space spools on the shaft 15, I provide collars 25 (FIGS. 2 and 3) which can be fixed to shaft by means of set screws 26 or the like. Compression springs 27 surrounding the shaft 15 and bearing against the collars 25 may be used to press against re-wind spools and to space the spools. These will adjust the tension with which the rewinding is done since the core of the spools thus will be allowed to slip slightly against friction generated by the pressure of the springs 27. The construction also will provide for slippage between cores if one is of different diameter than the other.

Figure 9:
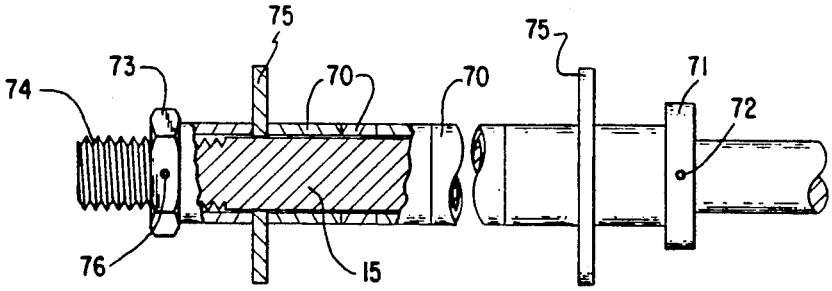
FIG. 9 is a detailed view of one of the driven shafts showing an alternate method of spacing and tensioning.

An alternate method of accomplishing the same purpose is shown in FIG. 9. In this embodiment, a series of cores 70, which may be cardboard, is fitted over the shaft. At least one of the cores, or some combination of cores makes a width equal to the width of each strip to be rewound on this shaft. Other cores are used as spacers between a collar 71 fixed to the shaft by a set screw 72 or the like and a nut 73 threaded onto a threaded end 74 of the shaft 15. End plates 75 may be used to define the spool onto which the strip is to be rolled.

Thus, the friction between various cores can be adjusted by tightening and loosening the nut 73. This nut may be held in an adjusted position by a set screw 76. The advantage of this device is that a much smaller part of the length of the shaft is required by the thread as opposed to a compression spring, and therefore more nearly the full length of the shaft is available for taking up rolled strips.

The material to be cut is ordinarily received on large rolls having a tubular core. On the machine, an axle 29 is threaded through the core of this roll 30. Conical or partly conical keepers 31 held in place on the axle 29 by set screws 32 or the like are used to center the roll radially and space the roll axially on the axle 29.

Figure 4:
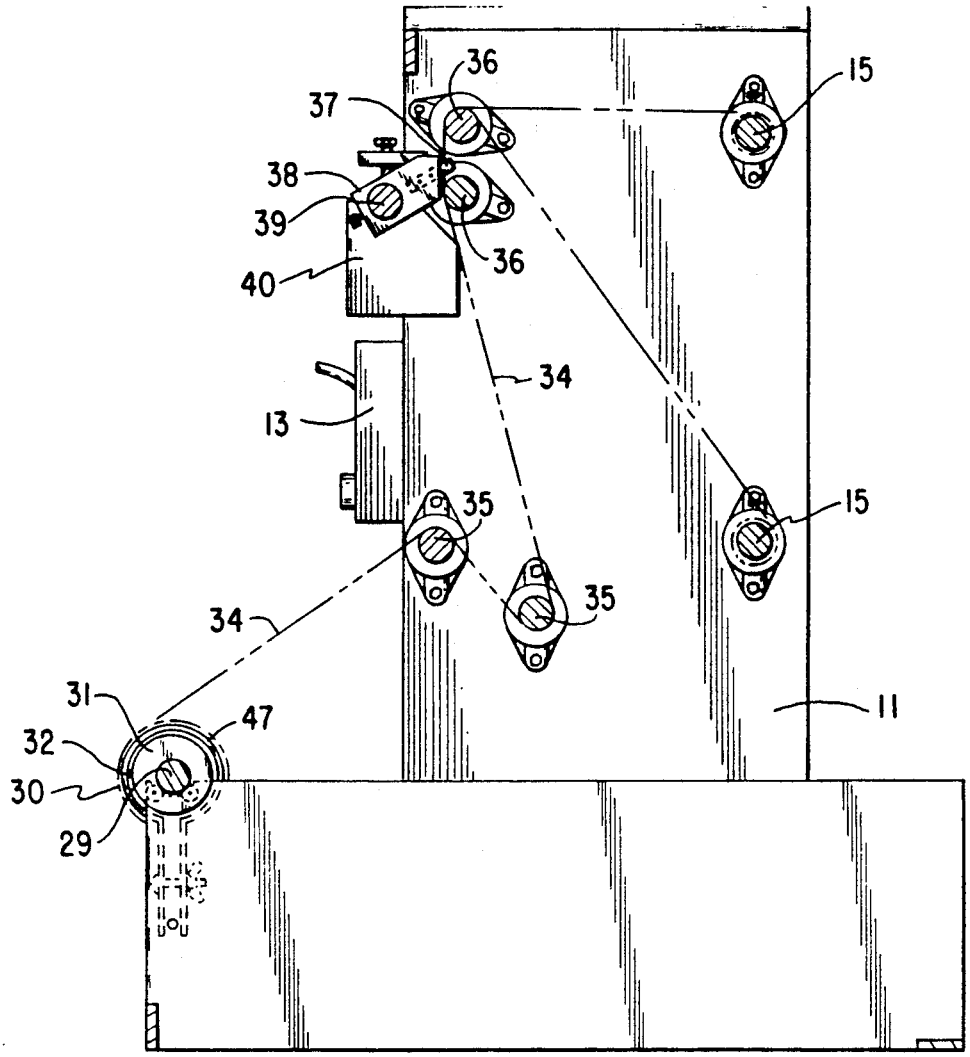
FIG. 4 is a sectional view from line 4—4 of FIG. 3.

From the roll 30, the sheet 34 of material passes over a series of idler shafts 35 (FIG. 4) which serve to direct the material in the proper course to the support axles 36. These support axles serve to support the material while the slitting knives 37 cut the material.

The knives 37 are held in collars 38 slidably mounted on a fixed bar 39. Although only two knives are illustrated, it is obvious that many more could be used depending on the width of the ribbons to be cut and therefore, the number of cuts to be made in the sheet 34. Set screws 40 may again be used to hold the collar 38 on the bar 39.

Figure 6:
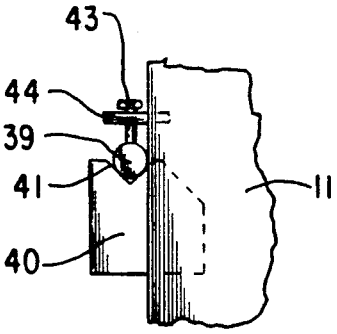
FIG. 6 is a view from line 6—6 of FIG. 3 showing the knife holding shaft and its holding means.

Both the idler shafts 35 and support shafts 36 can use the quick connecting mechanism shown at the bearing end of the drive shaft 15 in FIG. 7. Because neither the idlers nor the support shafts is driven, the slot and pin driving mechanism is unnecessary and therefore, may be omitted. It will be obvious that all of the shafts can be the same and therefore interchangeable. The driven stub shaft 16 will be used only for the drive shafts. On the idler and support shafts 35 and 36 there may be similar dummy stub shafts but without the pins 17 that hold the driven shaft 15 in driven relation with the stub shaft 16. In contrast, the knife holding bar 39 must be firmly held in position. To accomplish that holding, the plates 10 and 11 hold extensions 40 formed with a notch 41 (FIG. 6). The bar 39 is set into the notch 41 and is held there tightly centered by using a screw 43 threaded into brackets 44 also fixed to the plates 11 and 10. The bar 39, then, can be removed readily by releasing the screw 43. This might be desirable so that another bar, already set up with a different spacing of knives, can be put in place with a minimum of down time for the machine.

Figure 10:
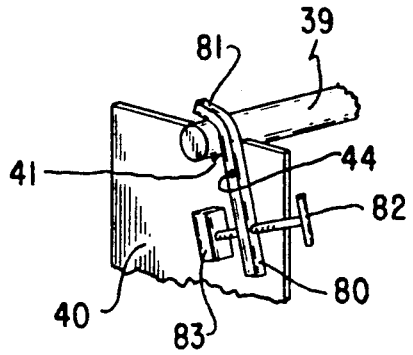
FIG. 10 is a detailed perspective view of an alternative device for holding the knife-holding bar.
Figure 11:
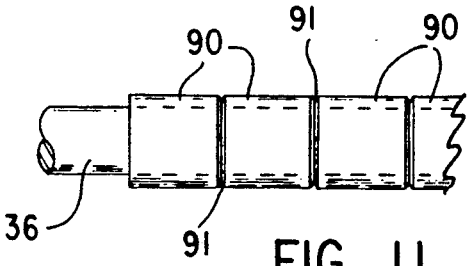
FIG. 11 is a view of an alternative support shaft.
Figure 12:
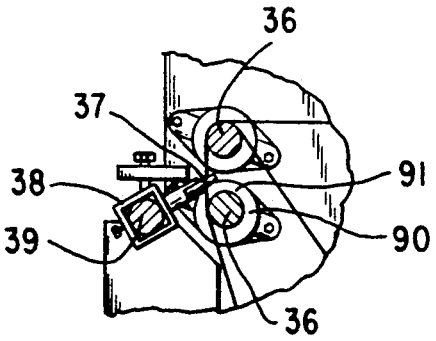
FIG. 12 is a sectional view of part of the support and cutting mechanism similar to part of FIG. 4.

There may be many ways of holding the knife-holding bar in place. One alternative is shown in FIG. 10. In this alternative, the plate extension 40 is still used. However, a curved holding lever 80 is pivotally attached at 44 to the extension 40. The curved end 81 of the lever extends above the notch 41 in position to engage the bar 39 or an alternative square bar 39'. In order to clamp the bar into the notch, a T-handled screw 82 is threadably engaged in the lever 80 and extends toward a block 83 welded onto the extension plate 40. Thus, threading the screw into the lever and against the block 83 will cause the curved end 81 to clamp down on the bar 39'. Use of such a fastening on both ends of the bar will serve to hold both the bar and the knife holders carried by it, firmly in place.

After the material 34 passes the knives, alternate strips may be rewound on spools located on the driven shaft 15. Thus, end plates 75 on the spools can be used without interference with an adjacent strip.

Figure 5:
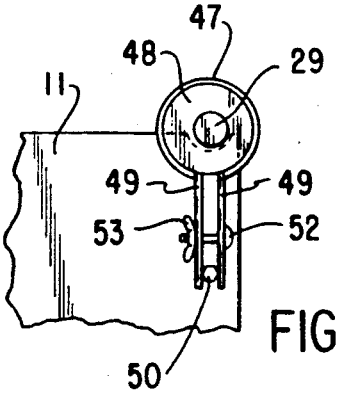
FIG. 5 is a partial view from line 5—5 of FIG. 3 showing only the load holding shaft and its brake mechanism.

In order to provide proper tension on the rewound strips and to prevent the roll 30 from spinning at a rate faster than the material is being rewound, a brake 46 may be used (FIG. 1). This brake consists of a springlike strip 47 wrapped around a drum 48 fixed to the end of the shaft 29 (FIG. 5). Although it is not necessary, some sort of material to generate friction may be used between the strip 47 and the drum 48 similar to any customary brake lining. The brake is held in place by extending the strip 47 to form two fingers 49 which may be clamped onto a stud 50 extending from the end plate 11. Clamping is accomplished by use of a screw 52 with a thumb nut 53 or by using a thumbscrew threaded into one of the fingers.

Loading and unloading means is also provided. A bar 60 is pivotally mounted on each of the plates 10 and 11. At their outer side, each bar 60 carries a plate. The plate 61 on the first bar is simply a bearing plate providing a bearing in which a hoist shaft 62 is journalled. The opposite plate 63 provides not only a bearing for the shaft 62, but also is used to mount a crank device 64. Obviously, if desired, the crank 64 may be replaced by a powered device such as an electric or hydraulic motor. The crank is adapted to drive the shaft 62 through a sprocket and chain device 65 which may be proportioned to provide the desired mechanical advantage.

Tapes or straps 67 are mounted on the hoist shaft 62. Hooks 68 are fixed to the ends of the tapes 67 and thus will be raised or lowered as the tapes are wound or unwound. The hooks 68 are adapted to engage the shaft 29 near its end. Alternately, if the hoist assembly is swung to the position shown in dashed lines in FIG. 1, the hooks will engage the shafts 15. Thus, the hoist is effective to lift a roll of material on the shaft 29 to lift it into place on the side plates, or to unload the roll of finished product from the plates by lifting the shafts 15 after the material has been wound onto them.

In use, the shaft 29 is inserted into the material and is centered into position through the use of the cones 31. It is then hoisted into place by using the mechanism just described, hooking the hooks 68 under the shaft 29 and lifting and then manually guiding the shaft into its proper location. The brake mechanism 46 is put into place and adjusted.

The material is then threaded over the idler shaft 35 and the support axles 36. Slits are started by placing the knives 37 and their bar 39 in place to cut an initial slit. These knives have previously been spaced properly on the bar. The slits may be extended to the end of the material so that initial winding or clamping of the material to the drive shafts 15 may be done.

For most materials, the spacing of the support shaft 36 on each side of the slitting knives 37 will work well. However, certain materials may require added support while the material runs over the knife. In such cases, the support shaft may be provided with bushing-like sleeves 90 which may be spaced apart slightly as shown at 91 so that the knife 37 will cut into that slot 91. The knife holder 38 may need to be modified slightly so that the knife 37 will be held in proper position to accomplish this, but in other respects the device will be exactly the same.

At this point, it is obvious that the winding of the ribbons onto both the shafts 15 will pull material from the initial roll over the knives 37 and result in slitting the material into narrower strips or ribbons as desired. When the roll has been fully slit, or when the desired amount of cut material has been rolled, the finished material still on its shaft, may be unloaded, by use of the hoist mechanism. If the original roll is not fully used, a new bar 39 using different spacing of knives 37 may be put in place and the procedure restarted.

If more than one shaft 15 is used, it may be desirable to use clutch mechanism in the power unit 12 to keep the tension on the two shafts approximately equal. Such mechanisms are well known in the art and are not shown here. However, my use of slipping reels on the driven shafts works satisfactorily so that the added complication may not be needed.

Thus, I have provided an efficient and effective tool for the cutting of strips or ribbons or the like from a roll of wide material.

I claim as my invention:

1. For slitting material on a roll into narrower strips, a machine comprising a frame, an axle for carrying said roll rotatably mounted on said frame, a bar mounted on said frame and slitting knives mounted in spaced relationship on said bar and at least one drive shaft also mounted on said frame, support means adjacent said knives to support said material as it passes said knives, said frame comprising a pair of plates held in spaced parallel relationship by bars fixed to said plates, hoist means mounted on said side plates, said hoist means being movable from a position over said axle carrying said roll to a position over said a first shaft holding drive shaft whereby said hoist means may be effective both for loading and unloading both the original roll of material and said at least one drive shaft holding rolls of the narrower strips, said hoist means including support means pivotally mounted on said side plates, a hoist shaft rotatably mounted on said said support means, tapes fixed to said hoist shaft whereby said tapes can be wound onto said hoist shaft, and hooks fixed to said tapes and engageable with said first shaft and said at least one drive shaft to lift and lower said first shaft and said at least one drive shaft.

2. The machine of claim 1 in which said hoist shaft is power driven.

* * * * *